US006539633B1

(12) United States Patent
Rebaudieres

(10) Patent No.: US 6,539,633 B1
(45) Date of Patent: Apr. 1, 2003

(54) RAZOR WITH SOUND INDICATOR SIGNALLING FIRST USE

(75) Inventor: Jean Bernard Rebaudieres, Compiegne (FR)

(73) Assignee: Societe Bic, Clichy (FR)

( * ) Notice: Subject to any disclaimer, the term of this patent is extended or adjusted under 35 U.S.C. 154(b) by 0 days.

(21) Appl. No.: 09/530,470

(22) PCT Filed: Oct. 28, 1998

(86) PCT No.: PCT/FR98/02311

§ 371 (c)(1),
(2), (4) Date: Jun. 28, 2000

(87) PCT Pub. No.: WO99/21690

PCT Pub. Date: May 6, 1999

(30) Foreign Application Priority Data

Oct. 28, 1997 (FR) ..... 97 13738

(51) Int. Cl.[7] ..... B26B 21/40

(52) U.S. Cl. ..... 30/34.05; 30/539; 30/84; 30/77

(58) Field of Search ..... 30/34.05, 539, 30/540, 357, 77, 84; 206/352, 354, 355, 359, 208, 807; 606/181, 182, 183

(56) References Cited

U.S. PATENT DOCUMENTS

| | | | | |
|---|---|---|---|---|
| 2,789,346 | A | * | 4/1957 | Algier et al. |
| 3,388,468 | A | * | 6/1968 | Hamill |
| 3,675,323 | A | | 7/1972 | Braginetz |
| 4,546,544 | A | * | 10/1985 | Kiraly et al. |
| 4,622,742 | A | * | 11/1986 | Lee |
| RE32,367 | E | * | 3/1987 | Bowman et al. |
| 4,679,324 | A | | 7/1987 | Kirk |
| 4,742,909 | A | * | 5/1988 | Apprille, Jr. et al. |
| 4,777,722 | A | * | 10/1988 | Trotta |
| 4,833,779 | A | * | 5/1989 | Iten |
| 5,012,578 | A | * | 5/1991 | Siefer |
| 5,518,114 | A | * | 5/1996 | Kohring et al. |
| 5,771,592 | A | * | 6/1998 | Nizker |
| 5,893,213 | A | * | 4/1999 | Motta |

FOREIGN PATENT DOCUMENTS

| | | | |
|---|---|---|---|
| EP | 0074814 | * | 9/1981 |
| FR | 2572983 | | 5/1986 |
| FR | 2646798 | | 11/1990 |
| GB | 2231297 | | 11/1990 |
| WO | WO 81/00229 | | 2/1981 |
| WO | WO 97/19612 | | 6/1997 |

* cited by examiner

*Primary Examiner*—Boyer Ashley
*Assistant Examiner*—Thomas J Druan, Jr.
(74) *Attorney, Agent, or Firm*—Pennie & Edmonds LLP

(57) ABSTRACT

The invention relates to a razor (1) whose head (2) is provided with a protective member (4) in which it engages in removable manner for the purpose of protecting the cutting blade(s) (3) before use and possibly also after use, the razor (1) having at least one tongue (6) fixed either to the head or to the protective member, and engaging respectively either on a portion of the protective member or on the head in such a manner as to be broken on first separation of the protective member (4) and the head (2). The protective member is preferably a cap (4) that engages removably on the head (2) of the razor to protect the cutting blade(s) (3) before and after use, and the tongue (6) is fixed to the head (2) of the razor, engaging a portion of the protective cap during removal thereof.

20 Claims, 4 Drawing Sheets

RAZOR WITH SOUND INDICATOR SIGNALLING FIRST USE

FIELD OF THE INVENTION

The present invention relates to a razor, in particular a discardable razor or a razor having a discardable head, in which the blade(s) is/are protected, on being obtained by the user, by means of a protective cap or housing.

BACKGROUND OF THE INVENTION

On purchasing a razor, the user cannot be sure that it has not already been used or that the blade has not been spoilt in one way or another. This uncertainty is particularly troublesome with a discardable razor or a razor having a discardable head, since by definition, the lifetime thereof is rather short, being about 5 to 7 uses, on average. Most discardable razors are indeed provided with a protective cap which engages on the head of the razor to protect the cutting blade(s). However, the presence of the protective cap is not sufficient to provide the user with a genuine guarantee since said cap is easily removed, and is designed to be put back into place on the razor head after each use. The same applies to discardable heads which are inserted in protective housings, insofar as it is possible to put a discardable head back into its housing after it has been used.

Naturally, one solution consists in selling the razor or the discardable head in appropriate packaging that must be destroyed in order to take hold of the razor or the head. However, under such circumstances, in order to be completely effective, it is necessary to have one package per razor or per head. When a plurality of razors or heads are sold in the same package, once the package has been opened, the user is again in a position of being unable to tell whether one or more of the razors (or heads) has been used, and this problem can arise whenever razors (or heads) are made available to a plurality of people.

Proposals have already been in document WO 97/19612 for a solution which consists in providing temporary fixing means that are fixed both to the protective cap and to the head of the razor, said means being constituted in particular by a strip of adhesive that needs to be removed manually or to be broken in order to be able to withdraw the protective cap from the razor so as to use it.

That solution requires additional means to be implemented, thereby complicating manufacture of the razor, and it also requires a special operation on behalf of the user and to which the user is unaccustomed.

SUMMARY OF THE INVENTION

The object of the Applicant is to propose a different solution to that problem which does not require packaging to be used and which mitigates the drawbacks of the solution proposed in document WO 97/19612.

This object is achieved in full by the razor of the invention which, in conventional manner, has a head fitted with a protective member in which it engages in removable manner to protect the cutting blade(s) before use, and possibly also after use, and which includes a part suitable for being broken on the first occasion the protective cap is removed.

In characteristic manner, the part in question is a tongue which is fixed either to the head or to the protective member and which bears respectively either on a portion of the protective member or on a portion of the head so as to be broken during first separation of the protective member and the head.

Thus, the tongue is an integral portion of one of the elements (head or protective member) and it is the usual action of separating these two elements which causes the tongue to be broken.

The noise caused by breaking the tongue constitutes an audible indication, thereby informing the user that the protective member which was put into place during assembly of the razor had not been previously been withdrawn, and thus that the use thereof which the user is about to undertake is indeed a first use.

When the invention is applied to a discardable razor or to a discardable-head razor, having a protective cap that engages in removable manner on the head of the razor to protect the cutting blade(s) before use and after use, in a first variant, the tongue is fixed on the razor head and engages with the portion of the protective cap while it is being removed. When the user removes the protective cap, it is necessary to exert a certain amount of traction on the razor in order to disengage the protective cap from the razor head. During relative displacement between the cap and the head, a portion of the cap engages the tongue and, in accordance with the invention, breaks it.

In a preferred embodiment, the inside face of the protective cap has a shoulder with an internal rectilinear surface which is substantially parallel to the plane of the tongue while the cap is in place on the razor head, and with an outside surface that is convex. In this embodiment, it is the internal rectilinear surface which engages the tongue and which imparts thereto the force required to break it while the cap is being removed. In contrast, the convex surface enables the cap to be put into place on the razor head in spite of the tongue being present; because of the convex shape, there is progressive mechanical action on the tongue which causes it to flex without breaking.

Preferably, the outer convex surface and the inner rectilinear surface constitute the longitudinal edge of the protective cap.

In order to avoid spoiling the appearance of the razor head, the tongue is preferably on the bottom face of the razor head.

When relating more specifically to a discardable razor constituted by elements made by molding or injecting a plastics material, the part suitable for being broken on first removal of the protective cap forms an integral portion of one of said elements of the head.

In another variant embodiment of the invention, the part that acts to provide an audible indication of first use is a tongue that is fixed to the inside face of the protective cap and that engages a portion of the razor head during removal of said cap.

Furthermore, it may be necessary to have not one but a plurality of tongues suitable for being broken during first removal of the protective cap, said tongues being offset from one another in the travel direction of the protective cap relative to the razor head while said cap is being removed, in such a manner as to give rise to a succession of breaking noises.

When relating to a razor system having discardable heads, optionally provided with protective caps, each discardable head in the system is inserted in a protective housing in which said head is engaged in removable manner, and in characteristic manner said system includes at least one tongue suitable for being broken on first removal of each head from its housing, under the same conditions as specified above.

BRIEF DESCRIPTION OF THE DRAWINGS

The present invention is best understood with reference to the attached drawings, in which.

DETAILED DESCRIPTION OF THE INVENTION

The razor 1 comprises a head 2 and a handle (not shown), said head 2 being fitted with a cutting blade 3. The razor is discardable and the head 2 is made up of various elements obtained by injecting or molding plastics material, e.g. polystyrene, which elements are assembled together by any appropriate means.

Figure 4:
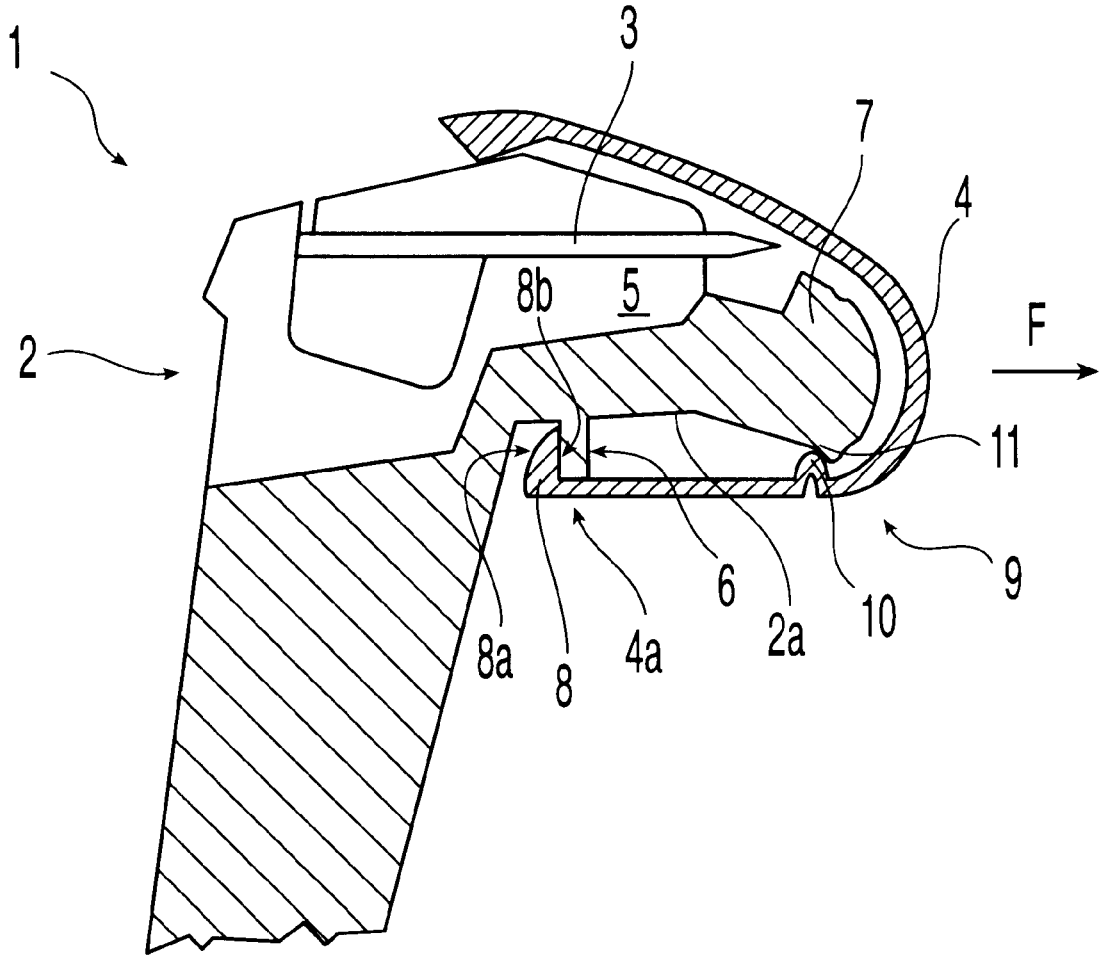
FIG. 4 shows another alternative embodiment of a discardable razor having an audible indicator of first use where the protective cap is held in position by an engaging element.

The razor 1 also carries a protective cap 4 which covers all of the front portion 5 of the head 2 and whose function is to protect the cutting blade 3. The protective cap 4 is designed so as to be engageable in a removable manner on said front portion 5. In the configuration shown in FIG. 4, it is held in position by any conventional means 9, e.g., by the presence of studs 10 formed by hot punching the protective cap, said studs 10 engaging in recessed portions 11 of the razor head 2, thereby establishing a certain amount of resistance against the protective cap 4 being removed.

According to the characteristic of the invention, the head 2 of the razor 1, including its protective cap 4, also includes a tongue suitable for being broken on first removal of the protective cap 4. This part constitutes an audible indicator, guaranteeing that the cap 4 has not previously been removed since the first time it was put on the head 2.

In the example shown, the tongue 6 is an integral portion of one of the elements 7 obtained by injecting or molding a plastics material. This tongue 6 is placed under the bottom face 2*a* of the head 2, substantially perpendicularly to said face 2*a*.

The longitudinal edge 4*a* of the protective cap 4 which is to be placed level with said bottom face 2*a* of the head 2 is terminated by a shoulder 8 that faces towards the inside of the protective cap 4. This shoulder 8 is in the form of a quarter circle, with a convex outer surface 8*a* and a rectilinear inner surface 8*b*.

On first assembly of the protective cap 4 on the head 2, it is the convex surface 8*a* which bears against the tongue 6. Because of the curvature of said convex surface 8*a*, the tongue is subjected to a force that is progressive, causing the tongue to bend without breaking. In contrast, when the user removes the protective cap 4, it is the rectilinear inner surface 8*b* which presses against the tongue 6, thereby applying a force which is instantaneously large and sufficient to break the tongue 6, thereby obtaining a significant sound signal on first use in accordance with the invention.

To ensure that the break is clean and reliable, the rectilinear inner surface 8*b* is preferably parallel to the plane of the tongue 6; in addition, the tongue 6 must be thin enough to ensure that the mechanical force necessary to break it is compatible with the force normally implemented by a user to remove the protective cap 4.

Figure 1:
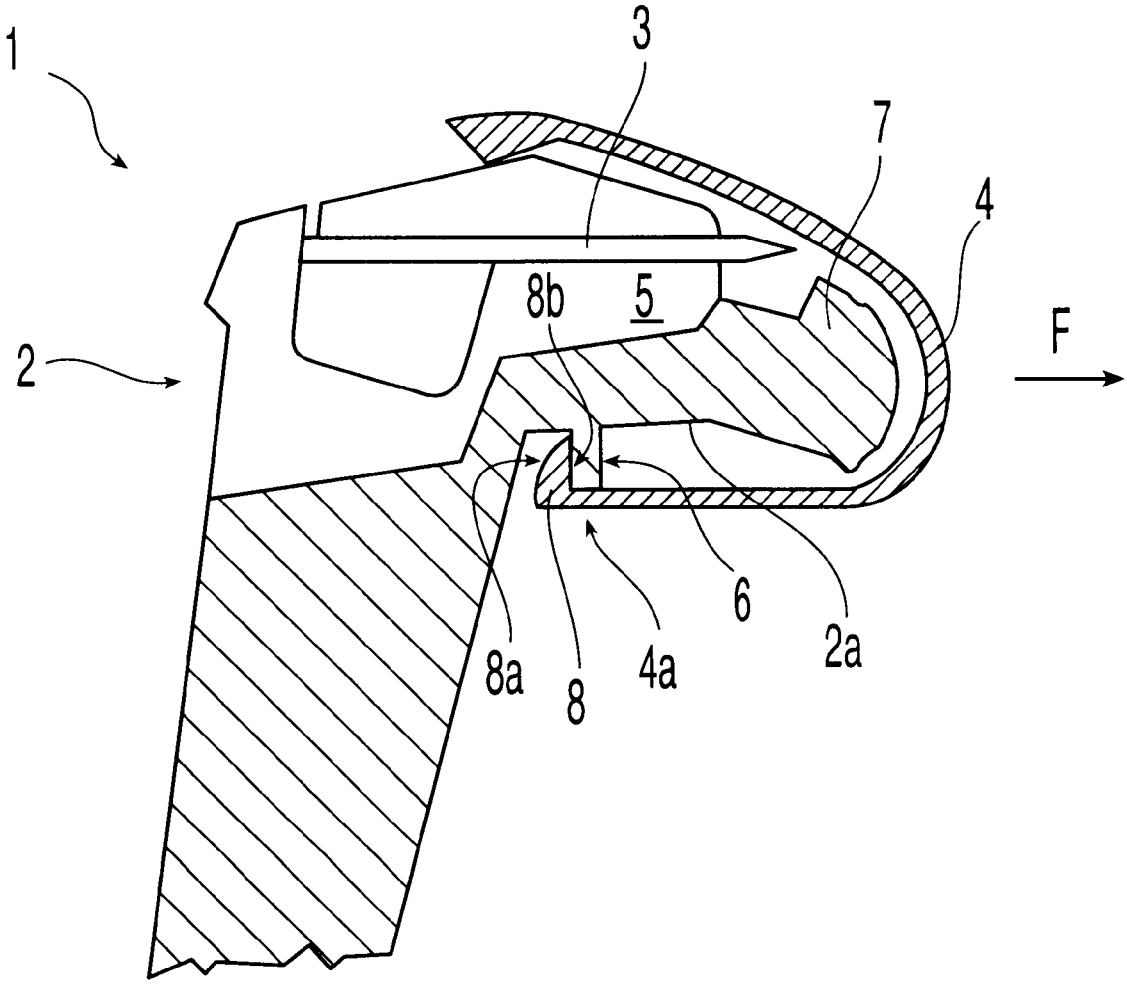
FIG. 1 shows a preferred embodiment of a discardable razor having an audible indicator of first use.
Figure 2:
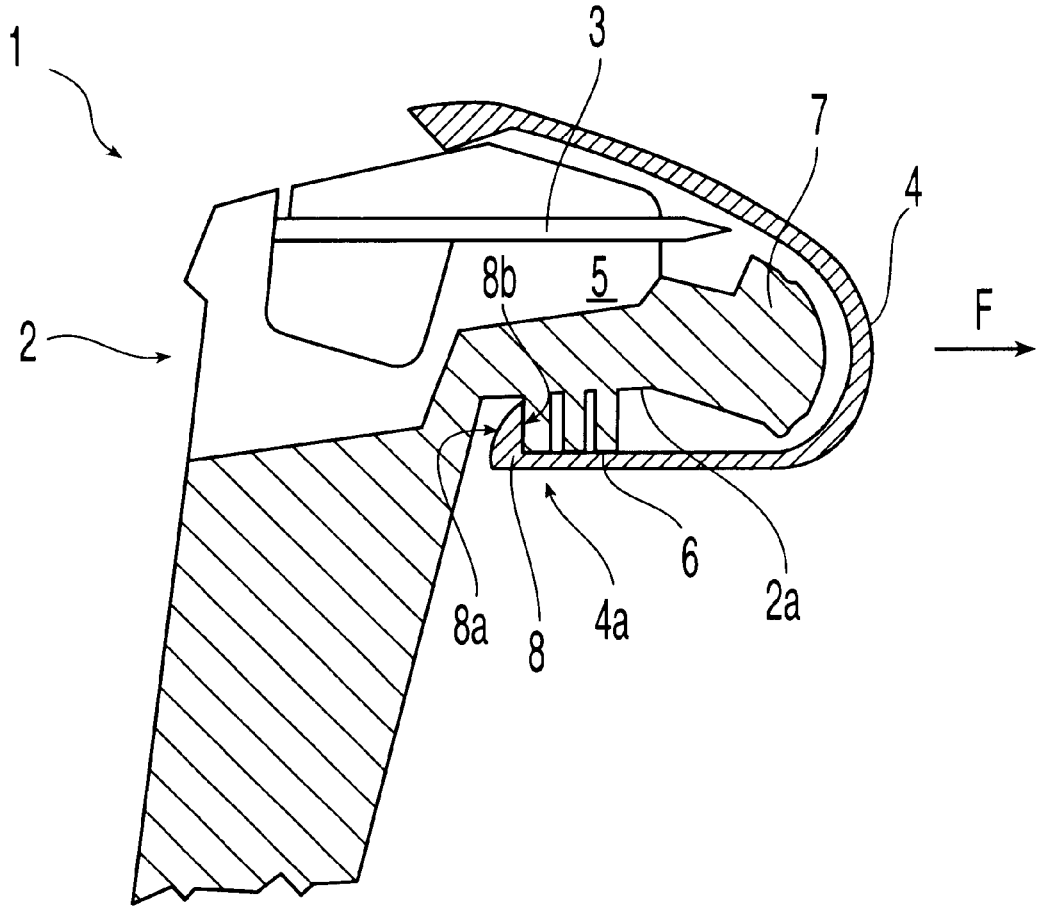
FIG. 2 shows an alternative embodiment of a discardable razor having an audible indicator of first use with a plurality of tongues on the head.

The present invention is not limited to the particular embodiment described above by way of non-exhaustive example. As shown in FIG. 2, it is possible to place a succession of tongues 6 on the bottom face 2*a* of the head 2, the tongues being offset from one another in the travel direction of the inner surface 8*b* while the cap 4 is being removed, thereby giving rise to a succession of breaks and thus to an effect of sounds in cascade.

Figure 3:
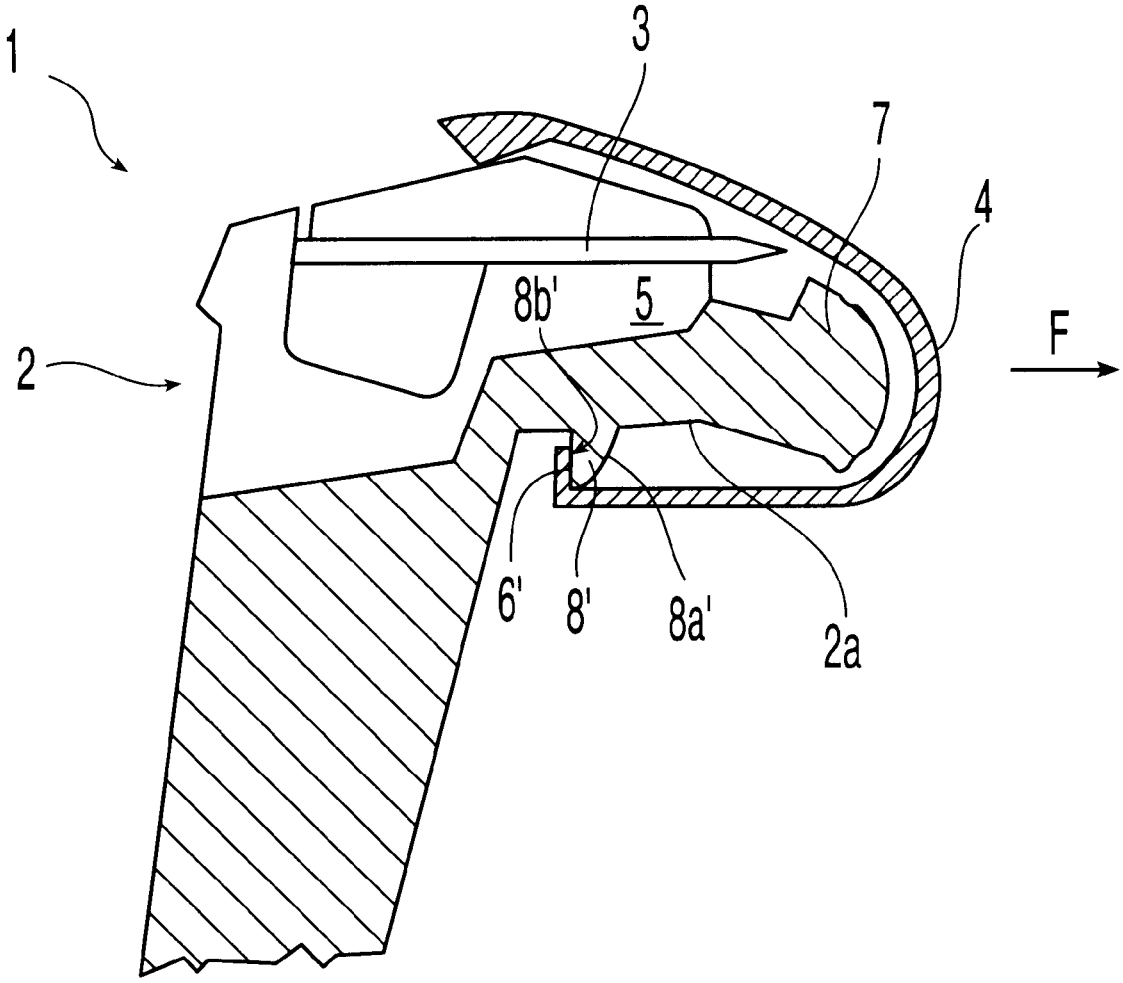
FIG. 3 shows another alternative embodiment of a discardable razor having an audible indicator of first use where the tongue is on the protective cap.

As shown in FIG. 3, it is also possible to fix the tongue for being broken not on the razor head but on the cap proper. Under such circumstances, it is a portion of the head 8, having a convex outer surface 8*a*' and a rectilinear inner surface 8*b*' that acts as the bearing surface, for breaking said tongue 6. However this alternative is more complex to implement compared with the example described above.

It is also possible to fix the tongue for being broken not on the razor head but on the cap proper. Under such circumstances, it is a portion of the head that acts as the bearing surface for breaking said tongue. However this alternative is more complex to implement compared with the example described above.

In the above description, the protective cap 4 is removed in a direction illustrated by arrow F in the figure. In the invention, other shapes of protective cap can also be used, including those which are withdrawn in a longitudinal direction relative to the cutting blades, i.e. a direction which is perpendicular to the section plane of the sole figure. Naturally, under such circumstances, the bearing surface is no longer in a longitudinal direction as stated above, but in a transverse direction.

Finally, the present invention applies not only to discardable razors as described above but also to shaving systems that comprise a razor with discardable heads, said heads being sold in batches and inserted in protective housings, each head being engaged in a corresponding housing. When a user seeks to use a new head, the headless razor is applied to a housing and mutual engagement means are inserted into the head, after which traction is exerted so as to extract the head from the housing in which it was engaged. If so desired, the user may possibly replace the head in its housing after it has been used by acting in the reverse order to that described above. In the invention, the razor system has a tongue suitable for being broken on first removal of the head from its housing. The tongue is fixed either to the housing or to the head under conditions similar to those described in the above example, i.e. engaging respectively either with a portion of the head or with a portion of the housing in such a manner as to be broken on first removal of the head from the housing. Thus, when the user removes the head from its housing for the first time after acquiring it, the desired sound effect is perceived, thereby guaranteeing that this is the first use of the head which is about to be used.

What is claimed is:

1. A razor comprising:

a head having a top face and a bottom face;

at least one cutting blade on said head, said cutting blade having a cutting edge;

a protective cap engageable with said head to protect said cutting edge and removable from said head in a removal direction perpendicular to said cutting edge;

at least one frangible tongue extending from one of said head or said protective cap in a direction transverse to said removal direction and having an engagement surface; and a shoulder projection on the other of said protective cap or said head and having an inner surface adjacent to and extending along said engagement surface of said frangible tongue when said protective cap is on said head of said razor prior to removal of said protective cap from said head for a first time;

wherein upon removal of said protective cap from said head for the first time, said engagement surface of said at least one tongue is engaged by said inner surface of said shoulder projection such that said surfaces are in a substantially non-sliding engagement relative to each other so that said at least one tongue is broken by said shoulder projection; and wherein an engaging element other than said tongue is provided on at least one of said head and said protective cap to hold said protective cap in position over said cutting edge in engagement with said head to protect said cutting edge after said tongue has been broken off upon first removal of said cap from said head.

2. A razor according to claim 1, wherein said at least one tongue is formed on said head and engages a portion of said protective cap when said protective cap is being removed from said head for the first time.

3. A razor according to claim 2, wherein said shoulder projection is on an inside face of said protective cap, said shoulder projection having a convex outer surface and a rectilinear inner surface substantially parallel and adjacent to said at least one tongue when said protective cap is on said head of said razor.

4. A razor according to claim 3, wherein said shoulder projection forms a longitudinal edge of said protective cap.

5. A razor according to claim 2, wherein said at least one tongue is on said bottom face of said head.

6. A razor according to claim 1, wherein:

said head is formed from elements obtained by molding or injecting a plastics material; and wherein said at least one tongue is an integral portion of one of said elements obtained by molding or injecting a plastics material.

7. A razor according to claim 1, wherein:

said protective cap has an inside face; and said at least one tongue is formed on said inside face of said protective cap and engages a portion of said head when said protective cap is being removed from said head for the first time.

8. A razor according to claim 1, wherein said at least one tongue includes a plurality of tongues suitable for being broken on first removal of said protective cap from said head.

9. A razor according to claim 8, wherein said plurality of tongues are offset from one another in the direction in which said protective cap travels relative to said head when said protective cap is being removed from said head for the first time.

10. A razor according to claim 1, wherein breakage of said at least one tongue provides an audible indication of first use.

11. The razor according to claim 1, wherein said protective cap is held in position on said head by studs, said studs engaging in recessed portions of said head.

12. A shaving system comprising:

a razor;

a discardable head having a top face, a bottom face, and at least one cutting blade having a cutting edge;

a protective housing engageable with said discardable head to protect said cutting edge and removable from said discardable head in a removal direction perpendicular to said cutting edge;

at least one frangible tongue extending from one of said discardable head or said protective housing in a direction transverse to said removal direction and having an engagement surface; and a shoulder projection on the other of said protective housing or said discardable head and having an inner surface adjacent to and extending along said engagement surface of said frangible tongue when said protective housing is on said discardable head of said razor prior to removal of said protective housing from said discardable head for a first time;

wherein upon removal of said protective housing from said discardable head for the first time, said engagement surface of said at least one tongue is engaged by said inner surface of said shoulder projection such that said surfaces are in a substantially non-sliding engagement relative to each other so that said at least one tongue is broken by said shoulder projection; and wherein an engaging element other than said tongue is provided on at least one of said discardable head and said protective housing to hold said protective housing in position over said cutting edge in engagement with said discardable head to protect said cutting edge after said tongue has been broken off upon first removal of said housing from said discardable head.

13. A shaving system according to claim 12, wherein said at least one tongue is formed on said discardable head and engages a portion of said protective housing when said discardable head is being removed from said protective housing for the first time.

14. A shaving system according to claim 13, wherein said shoulder projection is on an inside face of said protective housing, said shoulder projection having a convex outer surface and a rectilinear inner surface substantially parallel and adjacent to said at least one tongue when said protective housing is on said discardable head of said razor.

15. A shaving system according to claim 14, wherein said shoulder projection forms a longitudinal edge of said protective housing.

16. A shaving system according to claim 13, wherein said at least one tongue is on said bottom face of said discardable head.

17. A shaving system according to claim 12, wherein:

said discardable head is formed from elements obtained by molding or injecting a plastics material; and wherein said at least one tongue is an integral portion of one of said elements obtained by molding or injecting a plastics material.

18. A shaving system according to claim 12, wherein:

said protective housing has an inside face; and said at least one tongue is formed on said inside face of said protective housing and engages a portion of said discardable head when said protective housing is being removed from said discardable head for the first time.

19. A shaving system according to claim 12, wherein said at least one tongue includes a plurality of tongues suitable for being broken on first removal of said protective housing from said discardable head.

20. The shaving system according to claim 12, wherein said protective housing is held in position on said discardable head by studs, said studs engaging in recessed portions of said discardable head.

* * * * *